United States Patent [19]

Shiovitz et al.

[11] Patent Number: 5,067,386

[45] Date of Patent: Nov. 26, 1991

[54] RELEASE APPARATUS FOR SPIN STABILIZED SELF-PROPELLED PROJECTILES

[75] Inventors: Nathan N. Shiovitz, Anaheim; John G. Maloney, Diamond Bar; Michael F. Steele, Fountain Valley, all of Calif.

[73] Assignee: Brunswick Corporation, Skokie, Ill.

[21] Appl. No.: 195,657

[22] Filed: May 18, 1988

[51] Int. Cl.[5] ..... F41C 27/06; F41F 3/048; F41F 3/052

[52] U.S. Cl. ..... 89/1.808; 42/105

[58] Field of Search ..... 42/105; 89/1.808, 1.819; 102/377

[56] References Cited

U.S. PATENT DOCUMENTS

| | | | |
|---|---|---|---|
| 3,554,078 | 1/1971 | Horvath | 42/105 |
| 3,611,867 | 10/1971 | Silsby | 42/105 |
| 4,060,117 | 11/1977 | Chabot et al. | 42/105 |
| 4,270,293 | 6/1981 | Plumer et al. | 42/105 |
| 4,395,836 | 8/1983 | Baker et al. | 42/105 |
| 4,403,435 | 9/1983 | Baker et al. | 42/105 |

*Primary Examiner*—David H. Brown

*Attorney, Agent, or Firm*—Wood, Phillips, Mason, Recktenwald & VanSanten

[57] ABSTRACT

A release mechanism for facilitating launching a spin-stabilized self-propelled missile. A missile support includes a rotary turbine having a receptacle defining a spin axis, and a fixed support for supporting the rotary turbine for rotation about the spin axis and for movement axially of the spin axis. A nozzle assembly extends from the missile into the receptacle and includes a fusible joint for heating by high temperature exhaust gases expelled by the missile to release the missile, and an aft nozzle section movable away from the missile on fusing and separation of the fusible joint. An abutment on the rotary turbine is disposed in the path of movement of the aft nozzle section for striking by the aft nozzle section to effect rapid movement of the rotary turbine and receptacle axially away from the missile on fusing and separation of the fusible joint.

20 Claims, 1 Drawing Sheet

RELEASE APPARATUS FOR SPIN STABILIZED SELF-PROPELLED PROJECTILES

FIELD OF THE INVENTION

This invention generally relates to a projectile release mechanism and, particularly, to a release mechanism for facilitating launching a spin-stabilized self-propelled missile.

BACKGROUND OF THE INVENTION

It has become increasingly important to eliminate the features associated with a ballistic trajectory ordinarily followed by rockets and other jet-propelled projectiles, by forming the projectiles as spherical spin-stabilized missiles. The spherical missile spins about an axis upwardly inclined relative to the intended straight line path of flight and aligned with the missile propulsion thrust axis. The missile is released following ignition or activation of the propulsion system within the missile. The propulsion is effected by the reaction of the exhaust jet of, for example, a rocket motor housed within the spherical missile shell.

Often such spherical spin-stabilized missiles are provided in conjunction with attachments secured to the front end of an assault weapon such as a rifle.

Such spin-stabilized spherical self-propelled missiles experience difficulties in remaining stabilized during attainment of desired rotational speed and in coordinating the spinning and release of the missile. Release of the missile prior to attainment of adequate rotational speed can result in unstable flight. Delay of release after attainment of adequate rotational speed can result in a loss of propulsive range.

Consequently, attempts have been made to provide means for temporarily restraining and automatically releasing a spin-stabilized self-propelled spherical missile during spinup. For instance, in U.S. Pat. No. 3,245,350 to J. A. Kelly, dated Apr. 12, 1966, a mechanical release is provided between a rifle barrel and a spin-stabilized spherical missile in order to selectively release the missile. However, precise automatic release is not afforded. More specifically, U.S. Pat. No. 3,554,078 to Joseph S. Horvath, dated Jan. 12, 1971, provides a fusible link for temporarily restraining and automatically releasing a spherical spin-stabilized missile during spinup. Release of the spherical rocket missile from its rotary supporting means is effected by causing hot missile rocket exhaust gas to weaken by heating or to heat and soften or melt a separate fusible link member which, prior to weakening by softening or melting, secures the missile to the rotary support means. In this patent, the separate fusible link member is of the nature of a brazing alloy serving as one part of a nozzle assembly to secure the rocket to the rotary support means. The fusible link member is brazed between two separate fore and aft nozzle portions which are permanently secured to the missile and to the support means, respectively, as by threaded engagements.

An improvement on the aforementioned prior art is disclosed in U.S. Pat. No. 4,395,836 to Baker et al, dated Aug. 2, 1983 and assigned to the assignee of this invention, wherein a new and improved nozzle assembly is disclosed. The nozzle assembly includes a unitary nozzle member having fusible joint means formed integrally therewith, between the missile and the rotary support means, thereby eliminating the assembly and brazing operations of prior devices as shown in the Horvath patent, and thereby considerably reducing manufacturing costs and improving accuracy. However, in this patent the fore and aft sections of the unitary nozzle, forwardly and rearwardly of the fusible joint means, are permanently fixed to the missile and to the support means, respectively, as by threaded engagements.

Further improvements are shown in U.S. Pat. No. 4,403,435 to Baker et al, dated Sept. 13, 1983 and assigned to the assignee of this invention, wherein a further new and improved nozzle assembly includes projectile support means having open-ended receptacle means out of which fore and aft sections of the nozzle can move on fusing and separation of the fusible joint means. This patent also shows an improved register section for the missile or nozzle which is generally conical in configuration to improve alignment of the missile with the spin axis during initial separation of the fusible joint means.

The present invention represents somewhat of a radical departure from the prior art in that a mass is caused to be urged or propelled rearwardly by the gases of the missile or separate or combined other force generating mechanism to strike an abutment means on the turbine or rotary means for the missile to cause the rotary means in its receptacle, to move rapidly away from the missile after separation of the fusible joint means. The present invention thus allows positive missile retention by the launch system rotary means during coupling fusing and therefore eliminates pointing error tip off forces initiated by the coupling fusing in any of the prior art.

SUMMARY OF THE INVENTION

An object, therefore, of the present invention is to provide a new and improved projectile release mechanism for facilitating launching a self-propelled projectile, particularly a spin-stabilized missile.

In the exemplary embodiment of the invention, the mechanism includes missile support means having rotary means including receptacle means defining a spin axis, and fixed support means for supporting the rotary means for rotation about the spin axis as well as for movement axially of the spin axis. Nozzle means extend from the missile into the receptacle means, including fusible joint means for heating by high-temperature exhaust gases expelled by the missile to release the missile, and an aft nozzle section is movable away from the missile on fusing and separation of the fusible joint means. Abutment means are formed on the rotary means in the path of movement of the aft nozzle section for striking by the aft nozzle section to effect rapid movement of the rotary means and receptacle means axially away from the missile following fusing and separation of the fusible joint means and on impact of the aft nozzle means with the rotary means abutment.

Preferably, spring biasing means are operatively associated between the rotary means and the nozzle means, particularly the aft section of the nozzle means, for holding the nozzle means and, thereby, the missile in the receptacle means. In addition, detent means are provided between the rotary means and the fixed support means to prevent premature motion and post separation recoil of the rotary means after striking by the aft section of the support means.

Another feature of the invention includes a register section on the support means for receiving the missile, the register section and the missile having complementarily engageable, axially spaced concentric land means to insure proper alignment of the missile. One of the axially spaced land means, the forward land means shown herein, is of a cylindrical configuration, and the other or rear land means is of a forwardly opening conical configuration.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figures 1, 2, 3, 4:
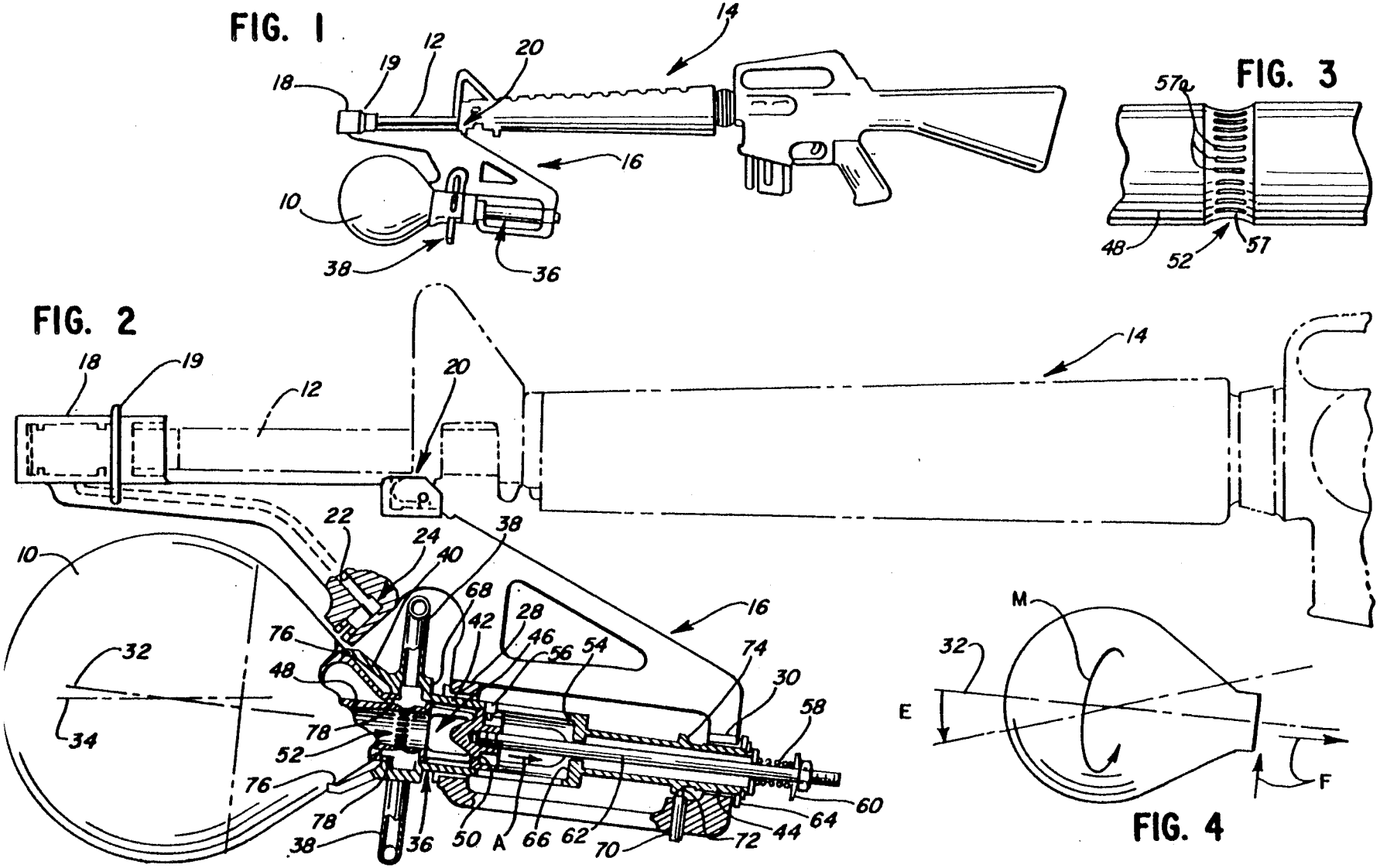
FIG. 1 is an elevational view of a spin-stabilized missile mounted on the barrel of a rifle and incorporating the release mechanism of the present invention.
FIG. 2 is a fragmented side elevational view, partially in section and on an enlarged scale, showing the interior components of the release mechanism of the present invention; prior to separation.
FIG. 3 is a fragmented elevation, on an enlarged scale, of the fusible joint means and the pattern of slots therein.
FIG. 4 is a somewhat schematic illustration of the effects of tip off and pointing error with spin-stabilized self-propelled missiles as incorporated in the invention.

Referring to the drawings in greater detail, and first to FIG. 1, a substantially spherical, spin-stabilized, self-propelled missile 10 is shown mounted to the front of a barrel 12 of an assault weapon such as a rifle, generally designated 14. The rifle shown is a standard M-16A2 military rifle or any similar device.

As shown in FIG. 1 and the enlarged view of FIG. 2, a missile support means, generally designated 16, include a front upper attachment portion 18 with axial motion restraint 19 and a rear attachment portion, generally designated 20. Bracket portion 18 is positioned on the barrel 12 whereby part of the gas emanating from the barrel is channeled through a passageway 22 (FIG. 2) to a firing pin assembly, generally designated 24, which is effective to strike a primer on missile 10 to ignite the rocket propellant therein, as is known in the art. The latch and the axial motion restraint means 19 are provided to lock support means 16 onto the rifle barrel.

Support means 16 also include turbine support portions 28 and 30 which support the missile and release mechanism on an axis 32 upwardly inclined relative to an intended straight-line path of flight 34 generally parallel to the axis of rifle barrel 12. As is known in the art, axis 32 is the spin axis of missile 10; i.e. the motor thrust axis of the missile rocket motor. Axis 34 which defines the line of flight of the missile is the forward velocity component thereof.

Generally, the self-propelled missile 10 is a spinning projectile launched from essentially a zero-length launcher. In other words, this is in contrast to a bullet which travels through the entire length of the rifle barrel. For accuracy and trajectory repeatability, the missile must be maintained in constant alignment with spin axis 32 during spin-up and release. Furthermore, since the rifle is fired and recoils during spin-up and release of the missile, the missile release must be practically instantaneous in order to prevent launcher/projectile impulse moments from redirecting the missile during and immediately after release. The present invention addresses these problems and has been shown to be effective in assuring an undisturbed spin-up and launch event not heretofore available with the prior art.

More particularly, referring specifically to FIG. 2, turbine rotary means, generally designated 36, include a plurality of turbine nozzles 38. Preferably, four nozzles are provided, 90 degrees apart, to provide uniform and equalized torque transmission forces. Four nozzles are used to reduce pressure drop variations across the coupling ports and equalize the exhaust gas flow through the coupling ports. The multiplicity of turbine arms accomplishes this by reducing the back pressure in the turbine plenum located between the coupling and the turbine air inlets and allowing smoother more evenly distributed exhaust flow through the coupling, coupling ports, turbine plenum and turbine arms. In assembly, rotary means 36 is rotatable within turbine support portions 28 and 30 by appropriate bearing means. The rotary means has a forward missile register section 40 for mating with missile 10, as described hereinafter, an intermediate receptacle section 42 journalled in support portion 28, and a rear distal end section 44 journalled in support portion 30. Thus, missile register section 40, receptacle section 42 and rear distal end section 44 are generally coaxial with spin axis 32.

A nozzle assembly, generally designated 46, includes a fore section 48 and an aft section 50 joined by an integral fusible joint means, generally designated 52. Intermediate receptacle section 42 of turbine rotary means 36 forms receptacle means for the nozzle assembly on spin axis 32. The fusible joint means 52 is similar to that shown in the aforementioned U.S. Pat. No. 4,395,836 and is disposed for heating by high-temperature exhaust gases expelled by missile 10 to release the missile from support means 16 and particularly from rotary turbine means 36. Details of such a fusible joint means can be derived from the aforesaid patent which is incorporated herein by reference. As disclosed herein, the fusible joint geometry has been refined to provide uniform heating and erosion and thereby assure that the separation event will occur simultaneously and abruptly across the entire joint surface or area, minimizing the time for complete separation. More particularly, as seen in FIG. 3, nozzle section 48 is a one-piece homogeneous nozzle member. A peripheral ring portion 57 is reduced in sectional thickness by appropriate machining operations. A precise pattern of equally spaced, axially extending slots or passages **57*a* form the fusible joint which is an integral part of the one-piece nozzle member and which is separated by the high-temperature exhaust gases expelled by missile 10**. The slots, versus the round holes of the aforementioned patent, provide an area which is more uniformly heated under the influence of a spring preload, and separates more nearly instantaneously (e.g. 0.001 seconds) across the whole transverse "plane" defined by the slots, with a minimum loss of preload prior to separation.

On fusing and separation of fusible joint means 52, fore and aft nozzle sections 48 and 50, respectively, are completely separated. Once separated, aft nozzle section 50 can move rearwardly in the direction of arrow "A" within receptacle section 42 of rotary turbine means 36. An axial slot 54 in receptacle section 42 guides a pin 56 extending therethrough and into aft nozzle section 50, thereby transmitting turbine torque to the missile 10. The aft section contains slots that vent exhaust gases after separation of the fusible joint.

The substantially zero-length launching and substantially instantaneous release of missile 10 is significantly facilitated by a unique mounting of rotary turbine means 36 in support means 16. The missile 10 is seated firmly in the register section 40 of rotary means 36 through the agency of a coil spring 58, bearing against the termination of rear distal end section 44 of the rotary turbine means and a washer 60 fixed to a rod 62 which, in turn, is fixed to aft nozzle section 50. The forward position of rotary means 36 is limited by a snap ring and washer assembly 64 so as to properly align the missile's percussion cap with firing pin assembly 24. Its aft location is fixed by plunger means 72, described hereinafter.

Upon fusing or failure of fusible joint means 52, aft nozzle section 50 recoils rearwardly under the action of the rocket motor gases and the preload of spring 58. The aft nozzle section moves rearwardly in the direction of arrow "A" and this recoiling mass strikes an abutment seat 66 on the interior of rotary turbine means 36. The kinetic energy of the recoiling mass is transferred to the rotary turbine means and is sufficient to overcome the load of spring loaded plunger 72, accelerating the rotary turbine means in an aft direction, stripping the mating lands (described hereinafter) between register section 40 of the rotary turbine means 36 and missile 10, leaving the missile free and with sufficient clearance to preclude recontact producing tipoff forces regardless of rifle/launcher motions. Rearward movement of the rotary turbine means is limited by a shoulder 68 which comes into engagement with the front of support means 16, at support portion 28. In essence, the invention provides a high speed (microseconds) separation for a more slowly moving projectile. In addition, "bounce-back" or recoil of the rotary turbine means 36 from impact with the support means is prevented by a detent means 70 which will project into the path of a ramp latch flange 74. The detent means is in the form of a spring loaded plunger 72 which bears against the ramped flange 74 about the distal end section 44 of the rotary turbine means, thus positioning the turbine in the rearward direction.

Another feature of the invention includes the provision of complementarily engageable, axially spaced concentric land means on register section 40 of rotary turbine means 36. More particularly, this interface comprises a large-diameter, cylindrical forward land 76 and a small-diameter, shallow angle conical aft land 78, both lands being concentric to missile spin axis 32. The two axially spaced land means are held in position axially by the spring loading (i.e. spring 58) between nozzle 46 and rotary turbine means 36, as described above. In contrast to a pair of conical lands, cylindrical land means 76 and conical land 78 can be machined within fine tolerances to maintain concentricity of the interfacing components and also provides a surface for carrying axial loads. Yet, conical land means 78 still affords the necessary seal for the mechanism.

The important contribution of the invention in terms of the reduction in "tip off" effects and reduction in separation time can best be described in relation to FIG. 4. More particularly, referring to that Figure, tip off forces "F" cause tip off moments "M". The time interval for which the tip off moment is applied to the missile is the moment impulse (Moment Impulse=M·t). The resulting precessional motion is a pointing error "E" which is proportional to the moment impulse (E=K·t·M). In prior constructions, the time "t" in the error equation has been relatively large (e.g. 10 milliseconds). This is the time during which the projectile has pulled away somewhat from register section 40 due to stretch of joint 52 during fusing and when "tipoff" forces due to rifle/projectile contact occur, stretch during fusing. With the invention, the missile is restrained during coupling fusing and, therefore, is not repointed as might be caused by coupling fusing initiated tip off forces. With the invention, the aft motion of the rear nozzle and its momentum transfer to the rotary means effect rapid aft motion of the rotary means. The aft motion effects rapid disengagement between the missile and the rotary means (e.g. 50–100 microseconds). This reduces both the tipoff impulse and the separation time by a factor of on the order of 100 and, thus, reduces the pointing error angle "E" by a factor of 100.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A release mechanism for facilitating launching a spin-stabilized self-propelled missile, comprising:

a missile;

missile support means including rotary means having receptacle means defining a spin axis, and fixed support means for supporting the rotary means for rotation about the spin axis and for movement axially of the spin axis;

nozzle means adapted to extend from the missile into said receptacle means, including fusible joint means for heating by high-temperature exhaust gases expelled by the missile to release the missile, and an aft nozzle section movable away from the missile on fusing and separation of the fusible joint means; and abutment means on the rotary means in the path of movement of the aft nozzle section for striking by the aft nozzle section to effect rapid movement of the rotary means and receptacle means axially away from the missile on fusing and separation of the fusible joint means.

2. The release mechanism of claim 1, including detent means between said rotary means and said fixed support means to prevent recoil of the rotary means after striking by the aft section of the nozzle means.

3. The release mechanism of claim 1 wherein said fusible joint means include a pattern of equally spaced, axially extending slots peripherally about the nozzle means forming passage means for conducting high-temperature exhaust gases therethrough.

4. The release mechanism of claim 1, including biasing means operatively associated between said rotary means and said nozzle means for holding the nozzle means and, thereby, the missile in said receptacle means.

5. The release mechanism of claim 4 wherein said biasing means is operatively associated between said rotary means and the aft section of the nozzle means.

6. The release mechanism of claim 1 wherein said rotary support means include a register section for receiving the missile, the register section and the missile having complementarily engageable, axially spaced concentric land means to insure proper alignment of the missile.

7. The release mechanism of claim 6 wherein one of said axially spaced land means is of a cylindrical configuration and another of the axially spaced land means is of a forwardly opening conical configuration.

8. The release mechanism of claim 7 wherein said one axially spaced land means is forward of said another axially spaced land means.

9. A release mechanism for facilitating launching a spin-stabilized self-propelled missile, comprising:

a missile;

support means including rotary means and means for supporting the rotary means for rotation about a spin axis and for movement axially of the spin axis;

nozzle means adapted to extend between said rotary means and the missile coaxial with said spin axis;

separation means between the missile and at least a separable portion of the nozzle means to allow said separable nozzle portion to move axially in an aft direction under the influence of exhaust gases expelled by the missile; and abutment means on the rotary means in the path of movement of and for striking by said separable nozzle portion to effect rapid movement of the rotary means axially away from the missile on separation of the separation means.

10. The release mechanism of claim 9, including means for preventing recoil of the rotary means after striking by said separable nozzle portion.

11. The release mechanism of claim 9 wherein said rotary means include receptacle means for receiving said nozzle means and defining said spin axis.

12. The release mechanism of claim 11, including biasing means operatively associated between said rotary means and said nozzle means for holding the nozzle means and, thereby, the missile in said receptacle means.

13. The release mechanism of claim 12 wherein said biasing means is operatively associated between said rotary means and said separable portion of the nozzle means.

14. The release mechanism of claim 9 wherein said support means include a register section for receiving the missile, the register section and the missile having complementarily engageable, axially spaced concentric land means to insure proper alignment of the missile.

15. The release mechanism of claim 14 wherein one of said axially spaced land means is of a cylindrical configuration and another of the axially spaced land means is of a forwardly opening conical configuration.

16. The release mechanism of claim 15 wherein said one axially spaced land means is forward of said another axially spaced land means.

17. A projectile release mechanism for facilitating launching a self-propelled projectile, comprising:

a projectile;

nozzle means adapted to extend from the projectile and defining an axis;

projectile support means generally coaxial with the nozzle means for receiving the nozzle means and for axial movement relative thereto;

separation means between the projectile and at least a separable portion of the nozzle means to allow said separable nozzle portion to move axially in an aft direction under the influence of exhaust gases expelled by the projectile; and abutment means on the support means in the path of movement of and for striking by said separable nozzle portion to effect rapid movement of the support means axially away from the projectile on separation of the separation means.

18. The projectile release mechanism of claim 17 wherein said separation means comprise fusible joint means.

19. A release mechanism for facilitating launching a spin-stabilized self-propelled missile, comprising:

a missile;

missile support means including rotary means and means for supporting the rotary means for rotation about a spin axis;

nozzle means adapted to extend between said rotary means and the missile coaxial with said spin axis;

separation means between the missile and the support means; and register means on the support means for receiving the missile, the register means and the missile having complementarily engageable, axially spaced concentric land means, one of the axially spaced land means being of a cylindrical configuration and another of the axially spaced land means being of a forwardly opening conical configuration.

20. The release mechanism of claim 19 wherein said one axially spaced land means is forward of said another axially spaced land means.

* * * * *